US012234606B2

(12) United States Patent
Johansson et al.

(10) Patent No.: US 12,234,606 B2
(45) Date of Patent: Feb. 25, 2025

(54) TISSUE PAPER MAKING MACHINE

(71) Applicant: VALMET AKTIEBOLAG, Sundsvall (SE)

(72) Inventors: Arvid Johansson, Lidköping (SE); Elin Engqvist, Karlstad (SE); Danilo Marcos, Karlstad (SE); Anders Lindén, Karlstad (SE); Johan Rågård, Karlstad (SE); Magnus Holmberg, Karlstad (SE); Jan Erikson, Karlstad (SE); Johan Björn, Karlstad (SE)

(73) Assignee: VALMET AKTIEBOLAG, Sundsvall (SE)

( * ) Notice: Subject to any disclaimer, the term of this patent is extended or adjusted under 35 U.S.C. 154(b) by 373 days.

(21) Appl. No.: 17/756,233

(22) PCT Filed: Dec. 18, 2020

(86) PCT No.: PCT/EP2020/087280
§ 371 (c)(1),
(2) Date: May 19, 2022

(87) PCT Pub. No.: WO2021/140014
PCT Pub. Date: Jul. 15, 2021

(65) Prior Publication Data

US 2022/0412005 A1 Dec. 29, 2022

(30) Foreign Application Priority Data

Jan. 9, 2020 (SE) ..... 2050010

(51) Int. Cl.
*D21F 11/14* (2006.01)
*D21F 5/18* (2006.01)
*D21F 9/00* (2006.01)

(52) U.S. Cl.
CPC ..... *D21F 11/14* (2013.01); *D21F 5/181* (2013.01); *D21F 9/003* (2013.01)

(58) Field of Classification Search
CPC ..... D21F 11/14; D21F 5/181; D21F 9/003; D21F 9/00
See application file for complete search history.

(56) References Cited

U.S. PATENT DOCUMENTS 5,230,776 A 7/1993 Andersson et al.
5,306,395 A 4/1994 Myren
(Continued)

FOREIGN PATENT DOCUMENTS

CN 1440480 A 9/2003
CN 101341291 A 1/2009
(Continued)

OTHER PUBLICATIONS

Consultoría de Tecnolgías Paeleras, S.L., "Crescent Former Tissue Machine Escher Wyss Max Sheet Width 2.740 mm Max Speed 1.800 m/min and Capacity 90 Tpd and Dismantled All Without the Yankee", (undated, but at least as early as 5 years ago), retrieved from the Internet at <URL: https://docplayer.net/49754022-Crescent-former-tissue-machine-escher-wyss-max-sheet-width-mm-max-speed-m-min-and-capacity-90-tpd-and-dismantled-all-without-the-yankee.html> on May 11, 2021, 11 pages.
(Continued)

*Primary Examiner* — Jacob T Minskey
*Assistant Examiner* — Matthew M Eslami
(74) *Attorney, Agent, or Firm* — Alston & Bird LLP

(57) ABSTRACT

The invention relates to a tissue paper making machine designed for possible rebuild from one concept to another. The machine comprises a forming section (2) and a Yankee drying cylinder (3) mounted to be rotatable about a first axis of rotation (A1). The forming section has a forming roll
(Continued)

mounted for rotation about a second axis of rotation (A2) which is parallel to the first axis of rotation (A1). The forming section (2) has a head box (5) and a first and a second forming fabric (6,7). The head box (5) is arranged to inject stock into a gap (8) between the first forming fabric (6) and the second forming fabric (7). The first forming fabric (6) is a felt that forms a loop and is arranged to carry a newly formed fibrous web (W) from the forming section (2) to the Yankee drying cylinder (3). The tissue paper making machine (1) comprises a press roll (9) arranged inside the loop of the first forming fabric (6) and forming a nip (N) against the Yankee drying cylinder (3). The distance (X) in the horizontal direction between the first axis of rotation (A1) and the second axis of rotation (A2) is in the range of 18 m-40 m.

13 Claims, 7 Drawing Sheets

(56) References Cited

U.S. PATENT DOCUMENTS

| | | | |
|---|---|---|---|
| 5,901,918 | A | 5/1999 | Klerelid et al. |
| 6,805,317 | B1 | 10/2004 | Andersson et al. |
| 2009/0314447 | A1 | 12/2009 | Aspegren et al. |
| 2011/0088859 | A1 | 4/2011 | Hulterantz et al. |
| 2014/0130997 | A1 | 5/2014 | Klerelid |
| 2019/0316296 | A1 | 10/2019 | Tolfsson et al. |
| 2019/0360155 | A1* | 11/2019 | Anzel ..... D21F 9/003 |

FOREIGN PATENT DOCUMENTS

| | | | |
|---|---|---|---|
| CN | 101952506 | A | 1/2011 |
| CN | 103874799 | A | 6/2014 |
| CN | 106968120 | A | 7/2017 |
| EP | 0874083 | A1 | 10/1998 |
| EP | 2290161 | A1 | 3/2011 |
| EP | 2126203 | B1 | 6/2012 |
| EP | 2920360 | B1 | 2/2017 |
| EP | 2963176 | B1 | 3/2017 |
| WO | WO 93/22498 | A1 | 11/1993 |
| WO | WO 02/02869 | A2 | 1/2002 |
| WO | WO 2007/073274 | A1 | 6/2007 |
| WO | WO 2009/067066 | A1 | 5/2009 |

OTHER PUBLICATIONS

International Searching Authority (ISA), International Search Report and Written Opinion received for International Application No. PCT/EP2020/087280, dated Apr. 20, 2021, 8 pages, European Patent Office, Netherlands.

Swedish Patent and Registration Office, Office Action, including Search Report, received for Application No. 2050010-4, dated Sep. 11, 2020, 8 pages, Sweden.

Valmet, Applicant's Informal Comments on ISA's Apr. 20, 2021 Written Opinion for International Application No. PCT/EP2020/087280, dated May 28, 2021, 3 pages, Sweden.2007073274.

Chinese Office Action for Chinese Patent Application No. 202080092423.4, dated Feb. 11, 2023, (8 pages), China National Intellectual Property Administration, Beijing, China.

Japanese Office Action for Japanese Patent Application No. 2022-537841, dated Jan. 6, 2023, (5 pages), Japan Patent Office, Tokyo, Japan.

"Paper Mall," (1 page), Feb. 24, 2014, [online], [retrieved from the Internet Jan. 6, 2023] <URL: https://www.kpps.jp/papermall/page/KAIGA/IKNP0004000>.

"Pulp and Paper Manufacturing Technology Series 6, Paper Making, First Edition, Japan," *Japan Technical Association of the Pulp and Paper Industry*, Dec. 14, 1998, pp. 423, 433, and 440.

* cited by examiner

TISSUE PAPER MAKING MACHINE

CROSS REFERENCE TO RELATED APPLICATIONS

This application is a National Stage Application, filed under 35 U.S.C. § 371, of International Application No. PCT/EP2020/087280, filed Dec. 18, 2020, which claims priority to Swedish Application No. 2050010-4, filed Jan. 8, 2020; the contents of both of which as are hereby incorporated by reference in their entireties.

BACKGROUND

Related Field

The present invention relates to a tissue paper making machine.

Description of Related Art

A standard design for a tissue paper making machine comprises a forming section with a head box, a forming roll and two forming fabrics of which one forming fabric is a foraminous wire and the other forming fabric is a water-absorbing felt. A fibrous web is formed in the forming section and carried by the water-absorbing felt from the forming section to a Yankee drying cylinder on which it is dried by heat and then creped off from the Yankee by means of a creping doctor and sent to a reel-up. Such machines produce standard tissue paper which is deemed acceptable for many applications. However, there is also an increasing demand for machines that are capable of producing tissue paper with higher bulk, better absorbency and higher softness than what can be achieved with the standard design. In practice, this can mean machines equipped with through-air drying cylinders (TAD cylinders) but alternatives to TAD machines are also known and typically include the use of textured or structured fabrics that are used to imprint a three-dimensional pattern into the fibrous web during the manufacturing process. While machines designed to produce tissue paper with a higher bulk and better absorbency produce a superior product, they also represent a greater investment and include additional components that require extra space. Since a tissue paper making machine will normally be used for many decades, the correct choice of machine design is important. If a machine is erected that is later found to be incapable of manufacturing the kind of tissue paper that is required, a rebuild will be a time-consuming project that results in a long period in which the machine is not operating at all. If, on the other hand, the machine that is originally erected is designed for making qualities that are not demanded, resources have been wasted. This presents a problem when a new machine is planned, and it is an object of the present invention to alleviate this problem.

BRIEF SUMMARY

The invention relates to a tissue paper making machine that comprises a forming section and a Yankee drying cylinder mounted to be rotatable about a first axis of rotation. The forming section has a forming roll mounted to be rotatable about a second axis of rotation which second axis of rotation is parallel to the first axis of rotation. The forming section further has a head box, a first forming fabric and a second forming fabric. The head box is arranged to inject stock into a gap between the first forming fabric and the second forming fabric and the first forming fabric is a water-absorbing felt that forms a loop and which is arranged to be capable of carrying a newly formed fibrous web from the forming section to the Yankee drying cylinder (i.e. the one and the same forming fabric extends around the forming roll and carries the newly formed fibrous web all the way to the Yankee drying cylinder). The machine further comprises a press roll that is arranged inside the loop of the first forming fabric and forms a nip against the Yankee drying cylinder. According to the invention, the distance in the horizontal direction between the first axis of rotation and the second axis of rotation is in the range of 18 m-40 m. For example, the distance in the horizontal direction between the first axis of rotation and the second axis of rotation may be in the range of 22 m-25 m, in the range of 22 m-28 m, in the range of 23 m-37 m or in the range of 18 m-21 m.

In embodiments of the invention, the distance in the vertical direction between the first axis of rotation and the second axis of rotation is less than or equal to than half the diameter of the Yankee drying cylinder.

In some embodiments of the invention, the tissue paper making machine is supported by a frame that rests on a machine floor that is so designed that the machine floor below the forming roll is at a higher vertical level than the machine floor below the Yankee drying cylinder.

DETAILED DESCRIPTION OF VARIOUS EMBODIMENTS

Figure 1:
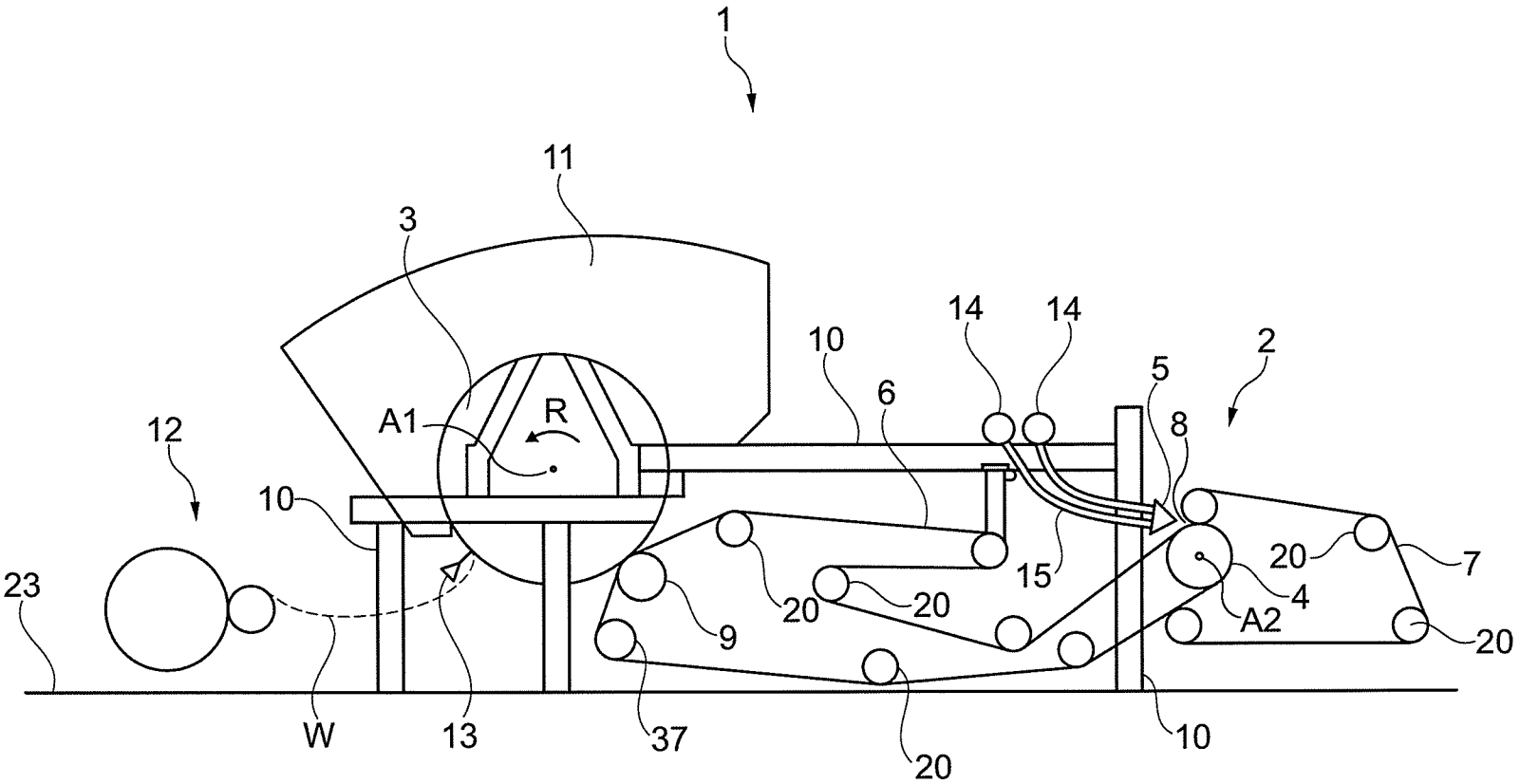
FIG. 1 is a side view giving a schematic representation of an embodiment of a common machine concept for making tissue paper.

With reference to FIG. 1, an embodiment of a common concept for tissue paper making machines is shown. The machine 1 of FIG. 1 comprises a forming section 2 that includes a head box 5 that receives stock from stock headers 14 through conduits/tubes 15. In FIG. 1, two stock headers 14 are shown but it should be understood that this is just an example and that there could be more than two stock headers or only one stock header. The head box 5 is arranged to inject stock into a gap 8 between a first forming fabric 6 and a second forming fabric 7. The second forming fabric 7 is suitably a foraminous wire that runs in a loop supported by lead rolls 20. The first forming fabric 6 is usually a felt that is capable of absorbing water but may conceivably also be a wire. The first forming fabric 6 runs in a loop supported by lead rolls 20. The forming section also comprises a forming roll 4 and a fibrous web is formed from the stock that is injected into the gap 8 between the forming fabrics 6, 7. The first forming fabric 6 is arranged to carry the newly formed fibrous web to a nip formed between a press roll 9 and a Yankee drying cylinder 3, i.e. the first forming fabric 6 not only forms a loop in which the forming roll 4 is located but also carries the newly formed fibrous web all the way to the Yankee drying cylinder 3 such that the fibrous web W is transferred to the outer surface of the Yankee drying cylinder 3 directly from the first forming fabric 6. The forming section 2 of FIG. 1 is designed as a crescent former. The press roll 9 may conceivably be a shoe roll arranged to cooperate with the Yankee drying cylinder 3 such that the nip between the press roll 9 and the Yankee drying cylinder 3 is a dewatering nip in which water is pressed out of the fibrous web. It should be noted that the press roll 9 does not have to be a shoe roll. The press roll 9 may also be, for example, a suction roll or a roll with a soft elastomer cover. In case of the press roll 9 being a shoe roll, the preceding roll 37 may be a suction dewatering roll. The nip between the press roll 9 and the Yankee drying cylinder 3 may also be a lightly loaded transfer nip in which no substantial dewatering takes place. In the nip between the press roll 9 and the Yankee drying cylinder 3, the fibrous web is transferred to the outer surface of the Yankee drying cylinder 3. The outer surface of the Yankee drying cylinder 3 is much smoother than the web-contacting surface of the first forming fabric 6 and the fibrous web will thus follow the outer surface of the Yankee drying cylinder 3 and the fibrous web is transferred from the first forming fabric 6 to the Yankee drying cylinder 3 in the nip formed between the Yankee drying cylinder 3 and the press roll 9. The Yankee drying cylinder rotates in the direction indicated by arrow R. On the Yankee drying cylinder 3, the fibrous web is dewatered by drying as the Yankee drying cylinder 3 is heated from inside by hot steam. The Yankee drying cylinder 3 may be, for example, a Yankee drying cylinder made of cast iron but it may also be a welded steel Yankee drying cylinder, for example as disclosed by EP 2126203 B1 or EP 2920360 B1. Optionally, a Yankee drying hood 11 may be arranged to cooperate with the Yankee drying cylinder 3 by blowing hot air against the fibrous web on the Yankee drying cylinder. If a Yankee drying hood 11 is used, the Yankee drying hood may be designed for example as disclosed by EP 2963176 B1 but other designs of the Yankee drying hood may also be considered. A creping doctor 13 is arranged to crepe the dried fibrous web W from the Yankee drying cylinder after which the dried and creped fibrous web W may e sent to a reel-up 12 as schematically indicated in FIG. 1. The reel-up 12 may take many different forms, for example as disclosed in U.S. Pat. No. 5,901,918 or as disclosed in U.S. Pat. No. 6,805,317.

As can be seen in FIG. 1, the tissue paper making machine 1 has a frame 10 which may be arranged to rest on a machine floor 23. The frame 10 can support various parts of the tissue paper making machine 1 such as for example the Yankee drying cylinder 3, the press roll 9 and the forming section 2 or parts thereof.

The general concept shown in FIG. 1 is a common and well tested concept which is often used to manufacture tissue paper. It can be seen as a conventional and reliable technology and produces tissue paper which is deemed to be of sufficient quality for many applications.

Figure 6:
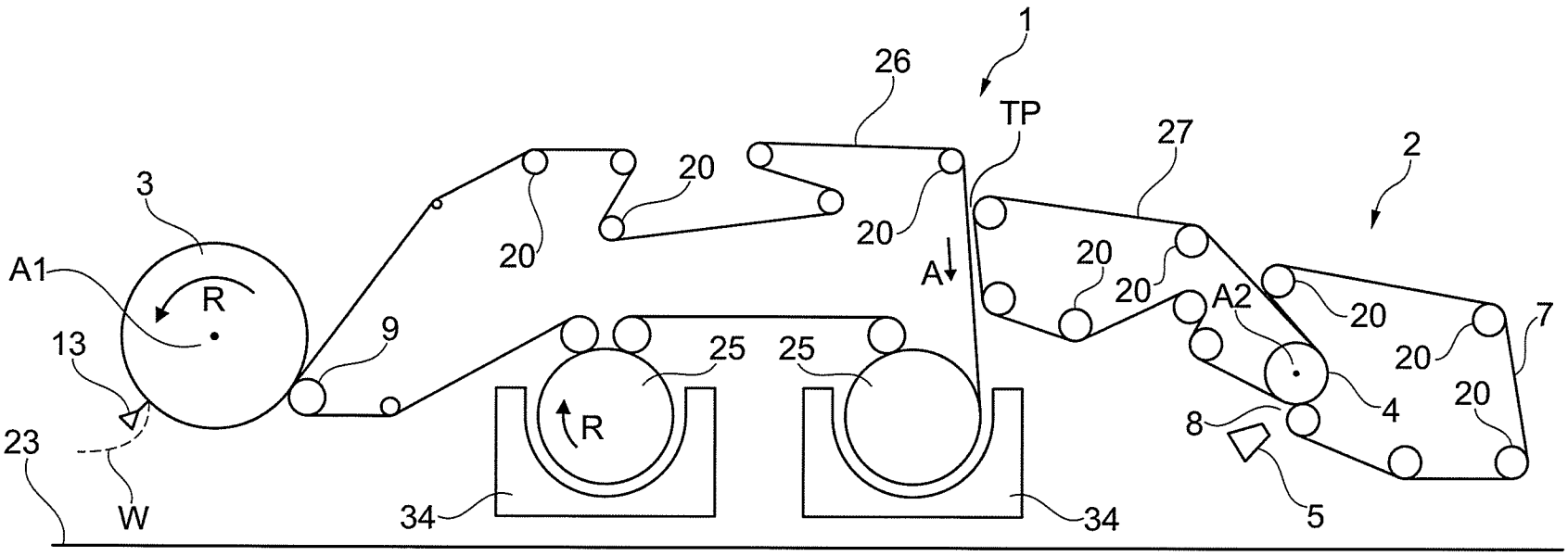
FIG. 6 is a side view of a tissue paper making machine with through-air drying cylinder.

A known alternative to the kind of concept that is shown in FIG. 1 is the through-air drying concept, commonly referred to as TAD. An embodiment of a machine using a TAD concept is shown in FIG. 6. With reference to FIG. 6, the forming section 2 may be designed as a C-former/C-wrap former. As in the machine of FIG. 1, the forming section has a head box 5 and a forming roll 4 and stock is injected from the head box 5 into the gap 8 between the forming fabrics 7, 27. The first and second forming fabrics 27, 7 are suitably both foraminous wires and the first forming fabric is arranged to carry the newly formed fibrous web to a transfer point TP where the fibrous web is transferred to a structured fabric 26 such as a TAD wire that runs in a loop, the transfer is suitably assisted by a suction device within the loop of the structured fabric 26. A certain speed difference may be used at the transfer point TP such that the structured fabric 26 runs at a lower speed than the first forming fabric 27, for example at a speed that is 2%-8% lower than the speed of the first forming fabric 27. The speed difference results in a so-called Rush Transfer or Wet Creping in order to increase the bulk of the fibrous web. In FIG. 6, the direction of travel of the structured fabric 26 is indicated by arrow A. The still wet fibrous web is carried by the structured fabric 26 along a path over two through-air drying cylinders 25, i.e. two TAD cylinders 25. The TAD cylinders 25 are arranged to be rotatable and, during operation, they will rotate in the direction of arrows R just as the Yankee drying cylinder 3 is rotating in the direction of arrow R. The TAD cylinders 25 are provided with hoods 34 and air can be blown either from the inside of the TAD cylinders 25 and radially outward or from the hoods 34 radially inward into the TAD cylinders. As hot air is blown through the fibrous web and the structured fabric 26 as they pass the TAD cylinders, the fibrous web is dried to a considerable extent and the pattern of the structured fabric 26 is pressed into the fibrous web such that it obtains a three-dimensional structure. The structured fabric 26 then carries the fibrous web to a Yankee drying cylinder 3 where final drying is carried out in the same way as explained with reference to FIG. 1 and the ready-dried fibrous web W can then be creped off with a creping doctor 13 and sent to a reel-up (not shown). Although not shown in FIG. 6, the Yankee drying cylinder 3 may be provided with a Yankee drying hood as in the machine of FIG. 1.

Machines according to such concepts as the one shown in FIG. 6 produce tissue paper that is generally much bulkier than tissue paper manufactured on machines built in a way similar to that of FIG. 1. Tissue paper manufactured on a TAD machine will have much higher absorbency that tissue paper manufactured on machines similar to that of FIG. 1 and will often also be softer/smoother. However, the operation of such a machine consumes more energy and thus becomes more expensive. Moreover, the TAD units require extra space.

In order to manufacture tissue paper with bulk, absorbency and other desirable qualities that are comparable to tissue paper manufactured on TAD machines, several different concepts have been proposed, usually concepts involving the use of a structured or textured fabric that is used to imprint a three-dimensional pattern into the fibrous web but without using TAD cylinders. Such technologies are sometimes referred to as "hybrid technology".

Figure 2:
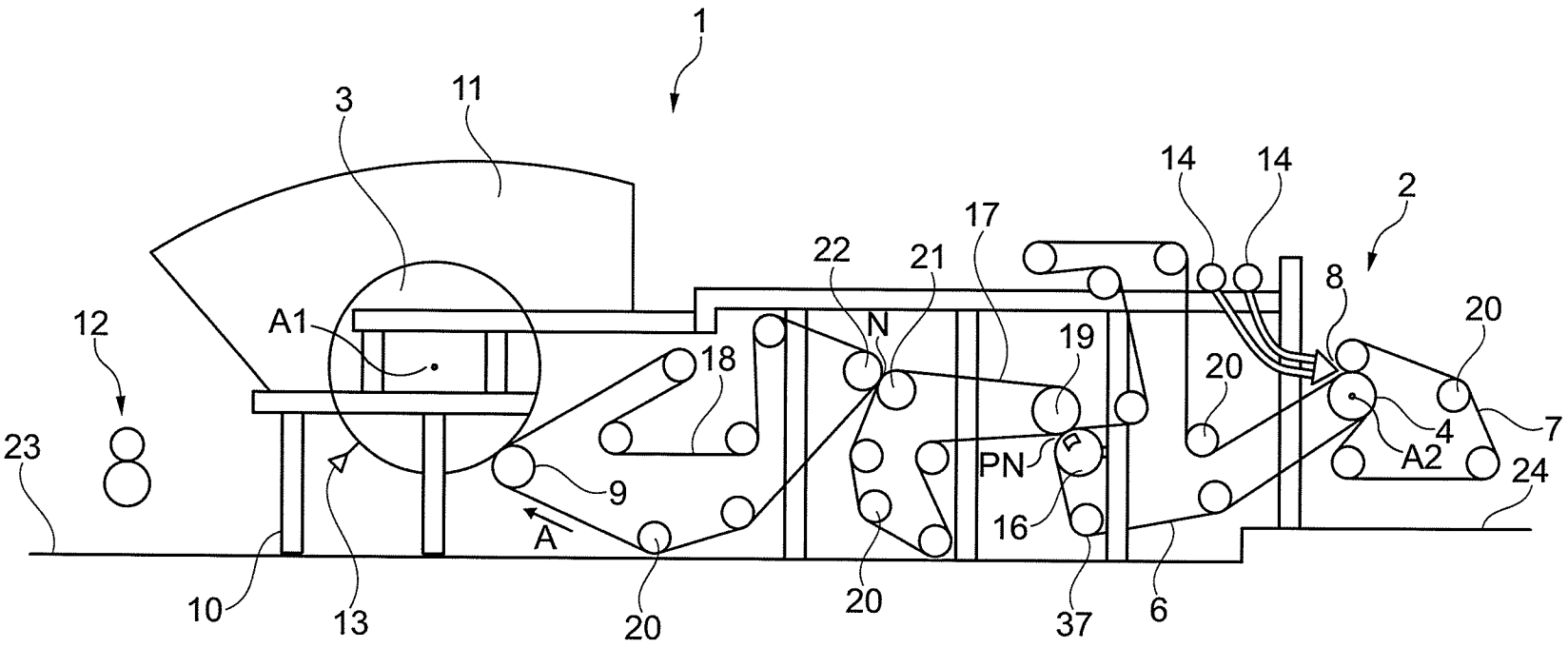
FIG. 2 is a side view of a tissue paper making machine for making tissue paper with a three-dimensional structure.

One example of a "hybrid" concept is disclosed in FIG. 2. With reference to FIG. 2, the forming section 2 is designed as a crescent former, just like the concept of FIG. 1, and it comprises a head box 5, a forming roll 4, a first forming fabric 6 which is a felt and a second forming fabric 7 which is a foraminous wire. Unlike the concept of FIG. 1, the first forming fabric is not arranged to carry the newly formed fibrous web to the Yankee drying cylinder 3. Instead, the first forming fabric 6 which runs in a loop guided by lead rolls 20 is arranged to carry the newly formed fibrous web to a dewatering press nip PN formed between the press rolls 16 and 19. The press roll 16 is located within the loop of the first forming fabric 6 and it may suitably, but not necessarily, be a shoe roll and the preceding roll 37 may possibly be a suction dewatering roll. The roll 19 may then serve as a counter roll for the shoe roll 16. In the dewatering press nip PN, the fibrous web is dewatered by pressing and transferred to a transfer belt 17 which has a smooth web-contacting surface formed by polyurethane or a material that comprises polyurethane or a material with properties similar to polyurethane. As the web-contacting surface of the transfer belt 17 is much smoother than the web-contacting surface of the first forming fabric 6 which is typically a water-absorbing felt, the fibrous web will be easily transferred to the transfer belt 17 which runs in a loop supported/guided by lead rolls 20. The transfer belt 17 carries the fibrous web to a nip N formed between the rolls 21 and 22 where the web is transferred to a structured fabric 18. In the nip N, the structured fabric 18 imprints a three-dimensional pattern into the fibrous web as the fibrous web and the structured fabric 18 are pressed together in the nip N. Suitably, a speed difference is used, i.e. a Rush Transfer, such that the structured fabric 18 moves slightly slower than the transfer belt 17. Thereby, additional bulk can be achieved. The structured fabric 18 is preferably air permeable. The structured fabric 18, which moves in the direction of arrow A, will then carry the fibrous web to the Yankee drying cylinder 3 where it is transferred to the outer surface of the Yankeed drying cylinder 3 in the nip formed between the press roll 9 and the Yankee drying cylinder 3. The fibrous web is then dried and creped from the Yankee drying cylinder as explained with reference to FIG. 1.

The machine concept shown in FIG. 2 is capable of producing a tissue paper with a high bulk and good absorbency thanks to the three-dimensional pattern imprinted into it by the structured fabric 18 and without using TAD cylinders that consume a large amount of energy. However, the extra equipment requires more space than the concept shown in FIG. 1.

Figure 4:
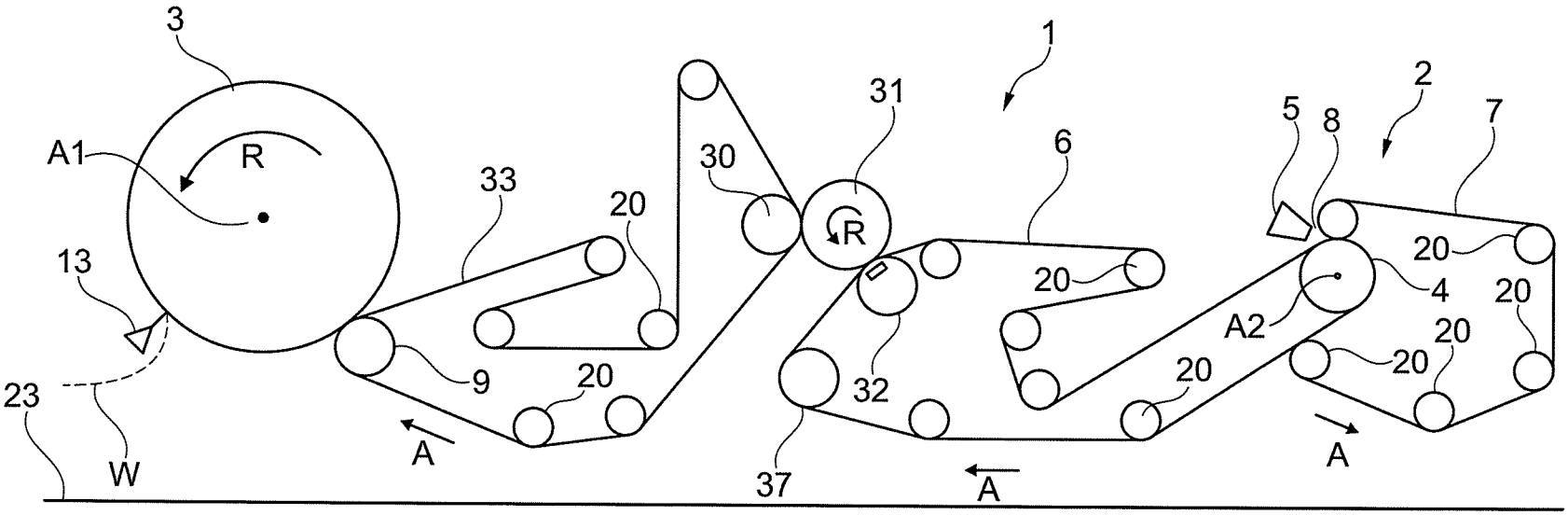
FIG. 4 is a side view of yet another machine concept for tissue paper making machines and which is suitable for making tissue paper with a three-dimensional structure.

A second hybrid concept tis shown in FIG. 4. With reference to FIG. 4, the forming section 2 (with a crescent former) has a head box 5, a forming roll 4, a first forming fabric 6 and a second forming fabric 7. The reference numeral 20 is used to indicate lead rolls. As in the concept according to FIG. 1, the first forming fabric 6 is suitably a water-absorbing felt while the second forming fabric 7 is a foraminous wire. Unlike the concept according to FIG. 1, the first forming fabric does not carry the newly formed fibrous web to the Yankee drying cylinder 3 but to a press nip between a press roll 32 and a counter roll 31. The press roll 32 is suitably a shoe roll with a flexible belt looping a shoe which may have a concave surface facing the counter roll 31. The preceding roll 37 may advantageously (but not necessarily) be a suction dewatering roll. The counter roll 31 may be a heated cylinder, i.e. a drying cylinder. To allow heating, one or several induction heating elements may be arranged outside or inside the counter roll 31. Alternatively, the counter roll can be heated in other ways, for example by steam that is supplied to the interior of the counter roll 31. In the nip between the press roll 32 and the counter roll, the fibrous web is transferred to the counter roll 31 which has a smooth outer surface. The fibrous web is then transferred from the outer surface of the counter roll 31 to an air and water permeable structured fabric 33. In FIG. 4, the reference numeral 30 indicates a creping roll that forms a wet-creping nip with the counter roll 31. The structured fabric 33 moves with a speed that is lower than the peripheral speed of the outer surface of the counter roll 31 such that a Rush Transfer is achieved in order to increase the bulk of the fibrous web. The structured fabric 33 has a three-dimensional pattern facing the fibrous web and the three-dimensional pattern is pressed into the fibrous web such that a three-dimensional pattern is imparted to the fibrous web. The fibrous web is then transferred to the smooth surface of the Yankee drying cylinder 3 in a transfer nip formed between the Yankee drying cylinder 3 and a transfer press roll 9. After drying on the Yankee drying cylinder 3, the fibrous web can be creped off from the Yankee drying cylinder by a creping doctor 13. The Yankee drying cylinder may optionally be provided with a Yankee drying hood. In FIG. 4, the arrows R and A indicate direction of rotation/movement.

The machine concept shown in FIG. 4 is capable of producing a tissue paper with a high bulk and good absorbency thanks to the three-dimensional pattern imprinted into it by the structured fabric 33 and without using TAD cylinders that consume a large amount of energy. However, the extra equipment still requires more space than the concept shown in FIG. 1 since the extra fabric 33 and the press formed by the rolls 31, 32 must be fitted in the area between the forming roll 4 and the Yankee drying cylinder 3.

Figure 5:
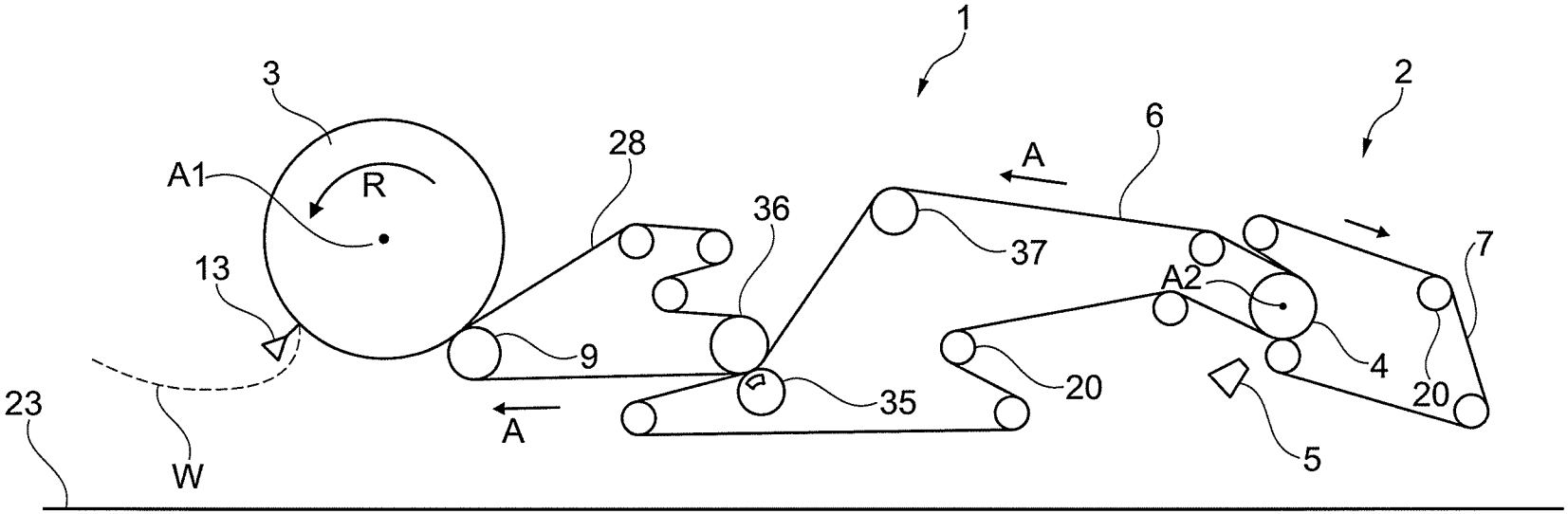
FIG. 5 is a side view of a further machine concept which is suitable for making tissue paper with a three-dimensional structure.

With reference to FIG. 5, a third hybrid concept will now be explained. Like the TAD concept shown in FIG. 6, this machine has a C-former forming section 2 and the forming section comprises a head box 5, a forming roll 4, a first forming fabric 6 and a second forming fabric 7. The first forming fabric 6 is a water-absorbing felt while the second forming fabric is a foraminous wire. The forming fabrics 6, 7 are supported/guided by lead rolls 20. In FIG. 5, the direction of rotation/movement is indicated by arrows R and A. The newly formed fibrous web is carried by the first forming fabric 6 to a dewatering nip formed between the press rolls 35 and a counter roll 36 where the fibrous web is dewatered by pressing. The press roll 35 is located within the loop of the first forming fabric 6 and it may suitably, but not necessarily, be a shoe roll. It may be preceded by a roll 37 which may possibly (but not necessarily) be a suction dewatering roll. A belt 28 which has a web-contacting surface formed by a material such as polyurethane picks up the web in the dewatering press nip formed between the rolls 35, and 36 and carries the fibrous web to the Yankee drying cylinder 3 where the web is dried by heat coming from hot steam supplied to the interior of the Yankee drying cylinder and the fibrous web can then be creped off from the Yankee drying cylinder 3 by a creping doctor 13. The web-contacting surface of the belt 28 is preferably textured such that a three-dimensional patent can be imprinted into the fibrous web to give the fibrous web increased bulk and absorbency. However, the web-contacting surface of the belt 28 may also be smooth. Optionally, a Yankee drying hood can be arranged over the Yankee drying cylinder 3 to increase the drying effect by hot air that is blown against the fibrous web. After creping, the fibrous web can be sent to a reel-up (not shown).

The machine concept shown in FIG. 5 is capable of producing a tissue paper with a high bulk and good absorbency. However, the extra equipment still requires more space than the concept shown in FIG. 1 since the extra components must be fitted in the area between the forming roll 4 and the Yankee drying cylinder 3.

In the machine concepts described above with reference to FIG. 2 and FIGS. 4-6, there must be enough space between the forming section 2 and the Yankee drying cylinder 3 that the various extra rolls and fabrics can be fitted into the machine. In practice, this means that the distance between the forming roll 4 and the Yankee drying cylinder must have a certain minimum value. For a prior art concept such as the one shown in FIG. 1, the distance along the horizontal axis from the axis of rotation A1 of the Yankee drying cylinder to the axis of rotation A2 of the forming roll 4, i.e. the distance corresponding to that indicated as X in FIG. 3, may be on the order of no more than 8 m-12 m which, in practice, is insufficient to fit the extra equipment needed for the concepts of FIG. 2 and FIGS. 4-6. For a machine concept such as the one shown in FIG. 2, the horizontal distance between the axis of rotation of the Yankee drying cylinder and the axis of rotation of the forming roll may typically be in the range of 22 m-25 m, for example 24 m or 24.2 m. For a concept such as the one shown in FIG. 6, that distance may be in the range of 23 m-37 m, for example 24 m or 36 m while the corresponding distance for the concept of FIG. 4 may be in the range of 22 m-28 m in many realistic embodiments. For the concept of FIG. 5, the distance may be in the range of 18 m-21 m, for example 20 m.

The inventors have realized that by providing a machine according to the standard concept of which FIG. 1 shows an example and extending the distance between the Yankee drying cylinder and the forming roll, it becomes possible to rebuild the machine much easier at a later stage if this should be required. Such a machine will thus be capable of operating according to the standard concept but can easily be modified into a different concept.

Figure 3:
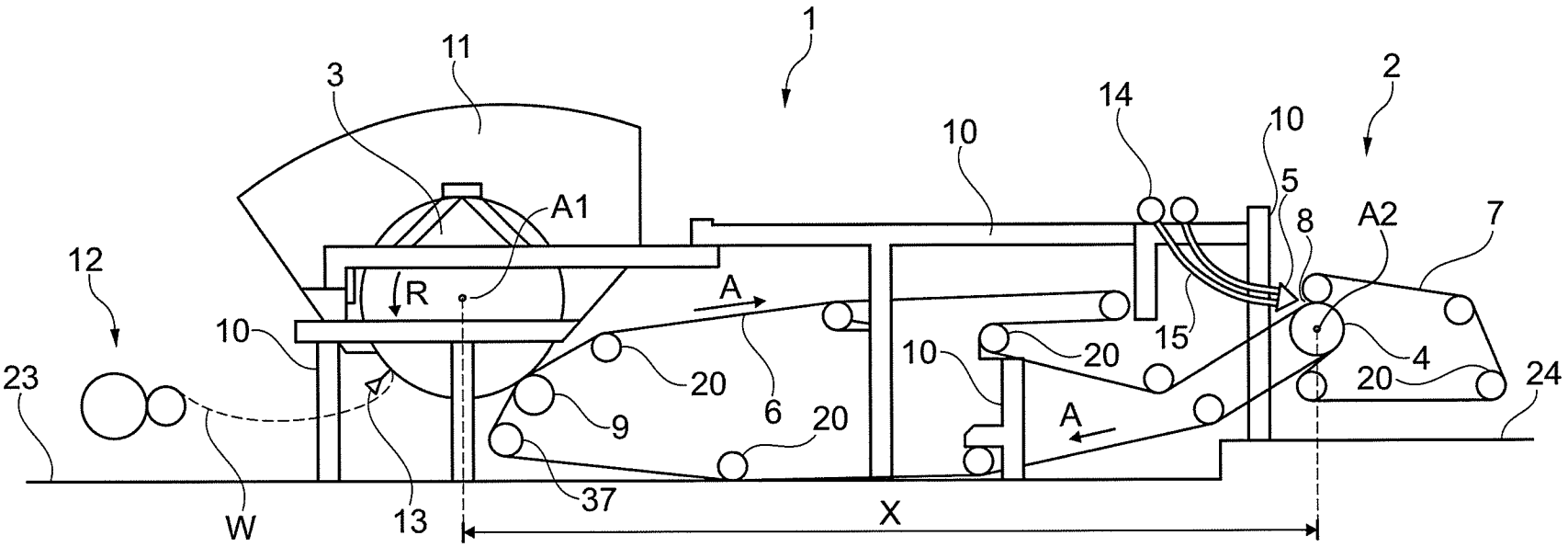
FIG. 3 is a side view of a tissue paper making machine built according to the same concept as shown in FIG. 1 but prepared to be rebuilt into the concept shown in FIG. 2.

With reference to FIG. 3, a tissue paper making machine 1 comprises a forming section 2 and a Yankee drying cylinder 3 mounted to be rotatable about a first axis of rotation A1. The forming section 2 has a forming roll 4 mounted to be rotatable about a second axis of rotation A2 which second axis of rotation is parallel to the first axis of rotation A1. The forming section 2 further comprises a head box 5, a first forming fabric 6 and a second forming fabric 7. The second forming fabric 7 is normally a foraminous wire that allows water to pass through it but does not absorb water. The head box 5 is arranged to inject stock in a gap 8 between the first forming fabric 6 and the second forming fabric 7. The first forming fabric 6 is a water-absorbing felt that forms a loop and it is arranged to be capable of carrying a newly formed fibrous web W from the forming section 2 to the Yankee drying cylinder 3. With regard to the terminology, it may be noted that the term "forming fabric" is sometimes understood as referring only to foraminous wires. In the context of this patent application and any patent that may be granted on the basis thereof, both fabrics 6, 7 are referred to as "forming fabrics" since they are both used in the forming section of the paper making machine. The tissue paper making machine 1 further comprises a press roll 9 arranged inside the loop of the first forming fabric 6 which forms a nip N against the Yankee drying cylinder 3. The nip N can be a dewatering press nip or just a lightly loaded transfer nip. The press roll 9 may be, for example, a shoe roll with a rotatable flexible belt that forms a loop around a shoe. The press roll 9 may advantageously (but not necessarily) be preceded by a suction dewatering roll 37. According to the invention, the distance X in the horizontal direction between the first axis of rotation A1 and the second axis of rotation A2 is preferably in the range of equal to or greater than 18.0 m and less than or equal to 40.0 m, more preferably in the range of equal to or greater than 22.0 m and less than or equal to 37.0 m, even more preferably in the range of equal to or greater than 23.0 m and less than or equal to 30.0 m and most preferably in the range of equal to or greater than 24.0 m and less than or equal to 30.0 m.

To accommodate for rebuild into a concept such as the one shown in FIG. 2, the preferred distance X can suitably be in the range of equal to or greater than 22.0 m and less than or equal to 25.0 m. To accommodate for rebuild into the concept shown in FIG. 6, the preferred distance X may be in the range of equal to or greater than 23.0 m and less than or equal to 37.0 m, for example 25.0 m or 30.0 m.

To have a machine prepared for rebuild to a concept such as the one according to FIG. 4, the distance X may suitably be in the range of equal to or greater than 22.0 m and less than or equal to 28.0 m for example 24.0 m, while a machine prepared for rebuild into a concept such as the one shown in FIG. 5 may be designed such that the distance X is in the range of equal to or greater than 18.0 m and less than or equal to 21.0 m.

To have the machine 1 prepared for rebuild into a concept such as the one shown in FIG. 2, the distance in the vertical direction between the first axis of rotation A1 and the second axis of rotation A2 should preferably be less than or equal to half the diameter of the Yankee drying cylinder 3.

Figure 7:
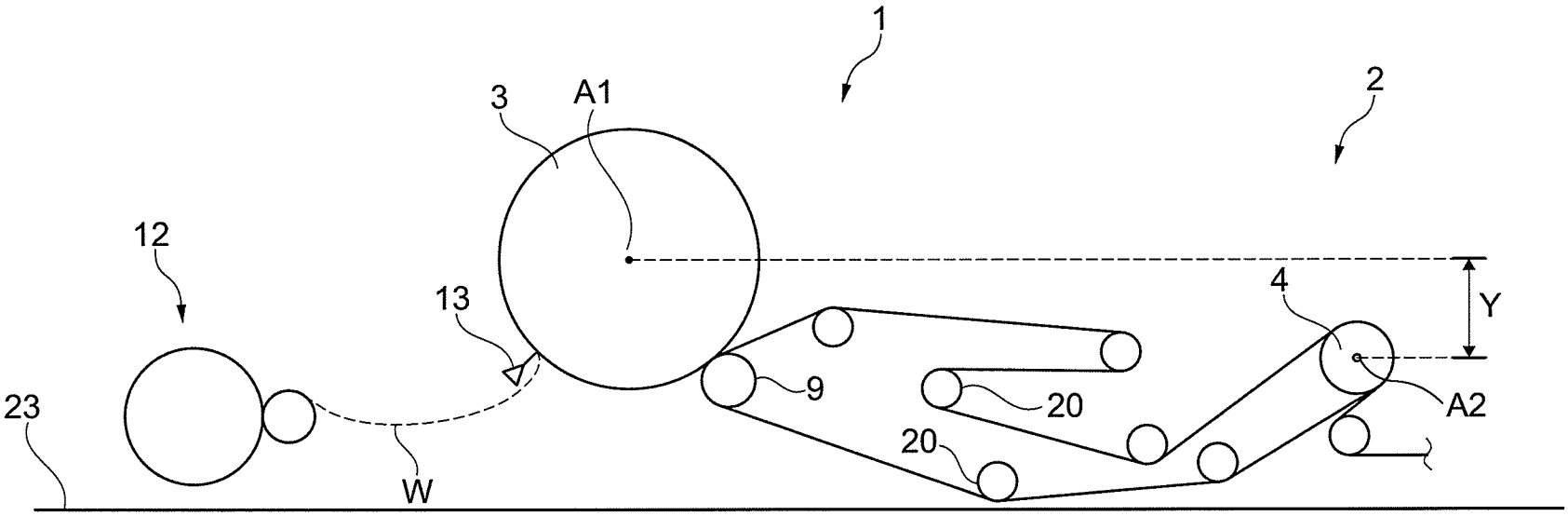
FIG. 7 is a side view largely similar to that of FIG. 1 but in which some of the machine components are not shown. The sole purpose of FIG. 7 is to explain a feature that may be suitable in some embodiments.

A brief reference to FIG. 7 will now be made. In FIG. 7, the reference sign Y refers to the vertical distance between the first axis of rotation A1 (the axis of rotation of the Yankee drying cylinder 3) and the second axis of rotation A2 (the axis of rotation of the forming roll 4). In other figures, the distance Y is not marked as such, but it will be understood that there is usually a certain vertical distance Y also in all machines/embodiments shown in FIGS. 1-6 although embodiments of the invention are conceivable in which there is no vertical distance, i.e. in which Y=0.0 m.

In all embodiments, the tissue paper making machine can suitably be supported by a machine frame 10 resting on a machine floor 23. Reference will now be made to FIG. 3. In order to make the inventive machine ready to be rebuilt into a concept such as the one according to FIG. 2, the distance Y in the vertical direction between the first axis of rotation A1 and the second axis of rotation A2 can be kept small by shaping the machine floor 23 such that the machine floor below the forming roll 4 is at a higher vertical level than the machine floor below the Yankee drying cylinder 3. With reference to FIG. 3, the machine floor has a raised/elevated part 24 in the area below the forming roll 4. In this way, there is room for a downward run of the first forming fabric 6 in the concept of FIG. 2 which is desirable in order to make ensure a correct amount of wrap around the roll 16 in FIG. 2.

It should be understood that in embodiments of the invention the vertical distance Y may conceivably be greater than half the diameter of the Yankee drying cylinder 3.

In one possible embodiment in which the inventive machine is prepared to be rebuilt into a machine as shown in FIG. 6, the diameter of the Yankee drying cylinder 3 may be 5.5 m, the horizontal distance X between the first axis of rotation A1 and the second axis of rotation A2 may be about 26.2 m and the vertical distance Y between the first axis of rotation A1 and the second axis of rotation A2 may be 1.6 m.

In another possible embodiment of the inventive machine in which the machine is prepared for rebuild into a machine as shown in FIG. 2, the diameter of the Yankee drying cylinder 3 may be 5.5 m, the horizontal distance X between the first axis of rotation A1 and the second axis of rotation A2 may be 23.4 m and the vertical distance Y between the first axis of rotation A1 and the second axis of rotation A2 may be 1.3 m.

The invention may also be understood in terms of a method of rebuilding a tissue paper making machine from a machine as defined by any of claims 1-8 into a machine as shown in any of FIGS. 2 or 4-6. Such a method would comprise the steps of replacing the felt and roll arrangement between the forming roll 4 and the Yankee drying cylinder 3 as shown in FIG. 3 with the arrangement of rolls and fabrics shown in any of FIGS. 2 or 4-6.

The Yankee drying cylinder 3 may be of many different dimensions but, in typical embodiments, the diameter of the Yankee drying cylinder would normally be in the range of 3.5 m-7.0 m, for example in the range of 3.5 to 6.7 m or from 3.5 to 6.5 m, and the width of the Yankee drying cylinder may be in the range of 2.5 m-8.0 m, for example 4.0 m, 4.7 m, 5.0 m or 6.0 m.

Thanks to the invention, a tissue paper making machine can be built for a standard concept and yet be easily rebuilt to a concept for making bulkier tissue paper with high absorbency. The long distance between the axes of rotation A1, A2 makes it possible to fit in the extra equipment needed for the concepts shown in FIG. 2, FIG. 4, FIG. 5 or FIG. 6 or other for making bulkier tissue paper with high absorbency without having to move these axis of rotation.

The invention claimed is:

1. A tissue paper making machine (1) comprising:

a forming section (2) having a forming roll (4), a head box (5), a first forming fabric (6) and a second forming fabric (7);

a Yankee drying cylinder (3) mounted to be rotatable about a first axis of rotation (A1); and a press roll (9) arranged inside the loop of the first forming fabric (6) and forming a nip (N) against the Yankee drying cylinder (3), wherein:

the forming roll (4) is mounted to be rotatable about a second axis of rotation (A2), which second axis of rotation (A2) is parallel to the first axis of rotation (A1), the head box (5) is arranged to inject stock into a gap (8) between the first forming fabric (6) and the second forming fabric (7), the first forming fabric (6) is a water-absorbing felt that forms a loop and which is arranged to be capable of carrying a newly formed fibrous web (W) from the forming section (2) to the Yankee drying cylinder (3), the distance (X) in the horizontal direction between the first axis of rotation (A1) and the second axis of rotation (A2) is in the range of equal to or greater than 20.0 m and less than or equal to 40.0 m, such that the distance (X) is configured to accommodate another component without having to move said first axis of rotation (A1) and said second axis of rotation (A2).

2. The tissue paper making machine according to claim 1, wherein the distance in the horizontal direction between the first axis of rotation (A1) and the second axis of rotation (A2) is in the range of equal to or greater than 22.0 m and less than or equal to 37.0 m.

3. The tissue paper making machine according to claim 1, wherein the distance (X) in the horizontal direction between the first axis of rotation (A1) and the second axis of rotation (A2) is in the range of equal to or greater than 23.0 m and less than or equal to 30.0 m.

4. The tissue paper making machine according to claim 1, wherein the distance (X) in the horizontal direction between the first axis of rotation (A1) and the second axis of rotation (A2) is in the range of equal to or greater than 24.0 m and less than or equal to 30.0 m.

5. The tissue paper making machine according to claim 1, wherein the distance X) in the horizontal direction between the first axis of rotation (A1) and the second axis of rotation (A2) is in the range of equal to or greater than 22.0 m and less than or equal to 28.0 m.

6. The tissue paper making machine according to claim 5, wherein the distance (X) is less than or equal to 25.0 m.

7. The tissue paper making machine according to claim 1, wherein the distance in the horizontal direction between the first axis of rotation (A1) and the second axis of rotation (A2) is in the range of equal to or greater than 23.0 m and less than or equal to 37.0 m.

8. The tissue paper making machine according to claim 1, wherein the distance X) in the horizontal direction between the first axis of rotation (A1) and the second axis of rotation (A2) is in the range of equal to or greater than 18.0 m and less than or equal to 21.0 m.

9. The tissue paper making machine according to claim 1, wherein the distance (Y) in the vertical direction between the first axis of rotation (A1) and the second axis of rotation (A2) is equal to or less than half the diameter of the Yankee drying cylinder (3).

10. The tissue paper making machine according to claim 1, wherein the distance (Y) in the vertical direction between the first axis of rotation (A1) and the second axis of rotation (A2) is greater than half the radius of the Yankee drying cylinder (3).

11. The tissue paper making machine according to claim 1, wherein the tissue paper making machine (1) is supported by a frame (10) that rests on a machine floor and wherein the machine floor below the forming roll is at a higher vertical level than the machine floor below the Yankee drying cylinder (3).

12. The tissue paper making machine according to claim 1, wherein the diameter of the Yankee drying cylinder is in the range of equal to or greater than 3.5 m and equal to or less than 7.0 m.

13. The tissue paper making machine according to claim 1, wherein the width of the Yankee drying cylinder is in the range of equal to or greater than 2.5 m and equal to or less than 8.0 m.

* * * * *